US011822359B1

(12) United States Patent
Shohet et al.

(10) Patent No.: US 11,822,359 B1
(45) Date of Patent: Nov. 21, 2023

(54) CURRENT BALANCING OF VOLTAGE REGULATORS

(71) Applicant: Acacia Communications, Inc., Maynard, MA (US)

(72) Inventors: Yuval Shohet, Maynard, MA (US); Robert Manlick, Maynard, MA (US)

(73) Assignee: ACACIA COMMUNICATIONS, INC., Maynard, MA (US)

( * ) Notice: Subject to any disclaimer, the term of this patent is extended or adjusted under 35 U.S.C. 154(b) by 259 days.

(21) Appl. No.: 17/411,656

(22) Filed: Aug. 25, 2021

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735
See application file for complete search history.

(56) References Cited

U.S. PATENT DOCUMENTS 4,100,433 A * 7/1978 Duffy ..... H03G 3/10 327/350
5,087,870 A * 2/1992 Salesky ..... H02H 3/38 361/87
7,161,393 B1 * 1/2007 Potanin ..... G05F 1/56 327/108
7,276,885 B1 * 10/2007 Tagare ..... G05F 1/577 323/267
7,336,058 B1 * 2/2008 Lo ..... G05F 1/575 323/269
8,334,662 B2 * 12/2012 Jin ..... H05B 45/46 315/300
9,209,762 B1 * 12/2015 Mortazavi ..... H03F 3/217
10,110,175 B1 * 10/2018 Abdelfattah ..... H03F 1/3247
10,216,209 B1 * 2/2019 Ham ..... G05F 1/575
2010/0283535 A1 * 11/2010 Li ..... G05F 1/577 327/535
2013/0027010 A1 * 1/2013 Groeneweg ..... G05F 1/575 323/280

(Continued)

FOREIGN PATENT DOCUMENTS

EP 3113578 A1 * 1/2017 ..... H02M 1/08

*Primary Examiner* — Thienvu V Tran
*Assistant Examiner* — Nusrat Quddus
(74) *Attorney, Agent, or Firm* — K&L GATES LLP

(57) ABSTRACT

A current-balanced voltage source may include two regulated voltage sources, each having an input and an output, and an amplifier to receive a control voltage at a positive input and a feedback voltage at a negative input. The output of each amplifier is coupled to the input of the respective regulated voltage source. The outputs of the regulated voltage sources are coupled together to source a current to a load. A differential amplifier may include positive and negative differential inputs, and positive and negative differential outputs. The positive differential input is coupled to the output of the first regulated voltage source and the negative differential input is coupled to the output of the second regulated voltage source. The positive differential output provides the feedback to the first regulated voltage source, and the negative differential output provides the feedback to the second regulated voltage source.

19 Claims, 8 Drawing Sheets

(56) References Cited

U.S. PATENT DOCUMENTS

| | | | | |
|---|---|---|---|---|
| 2013/0033242 | A1* | 2/2013 | Gunther | G05F 1/56 323/268 |
| 2013/0077383 | A1* | 3/2013 | Huang | G11C 13/0004 365/148 |
| 2013/0119954 | A1* | 5/2013 | Lo | G05F 1/10 323/280 |
| 2014/0176231 | A1* | 6/2014 | Spinella | G01P 15/125 327/538 |
| 2016/0291621 | A1* | 10/2016 | Whidden | G05F 1/577 |
| 2016/0299518 | A1* | 10/2016 | Iwata | G05F 1/468 |
| 2016/0366733 | A1* | 12/2016 | Wang | H05B 45/3725 |
| 2017/0083033 | A1* | 3/2017 | Park | G05F 1/59 |
| 2017/0293312 | A1* | 10/2017 | Hu | G05F 1/67 |
| 2017/0329360 | A1* | 11/2017 | Burgio | G05F 1/56 |
| 2018/0314285 | A1* | 11/2018 | Susanto | H04L 25/0276 |
| 2019/0079552 | A1* | 3/2019 | Yasusaka | G05F 1/461 |
| 2019/0278313 | A1* | 9/2019 | Mills | G05F 1/575 |
| 2019/0317536 | A1* | 10/2019 | Liu | G05F 1/462 |
| 2019/0364625 | A1* | 11/2019 | Brower | G05F 1/577 |
| 2019/0384337 | A1* | 12/2019 | Lu | G05F 1/575 |
| 2020/0004281 | A1* | 1/2020 | Chao | G05F 1/461 |
| 2020/0042026 | A1* | 2/2020 | Wang | G05F 1/575 |
| 2020/0259474 | A1* | 8/2020 | Ippolito | H03F 3/393 |
| 2020/0285259 | A1* | 9/2020 | Torrisi | G05F 1/565 |
| 2021/0278867 | A1* | 9/2021 | Wang | G05F 1/468 |
| 2022/0035393 | A1* | 2/2022 | Hafizi | H03K 17/6871 |
| 2022/0100218 | A1* | 3/2022 | Jung | G05F 1/575 |
| 2022/0334604 | A1* | 10/2022 | Kim | G09G 3/3225 |

* cited by examiner

CURRENT BALANCING OF VOLTAGE REGULATORS

FIELD

This disclosure relates generally to the field of voltage supplies for electronic equipment, and specifically to linearly regulated voltage supplies.

BACKGROUND

Contemporary optical communications and other photonic systems make extensive use of photonic integrated circuits that are advantageously mass-produced in various configurations for various purposes.

SUMMARY

In one aspect, a current-balanced linear voltage source may include a first regulated linear voltage source, a second regulated linear voltage source, and a differential amplifier having a positive differential input, a negative differential input, a positive differential output, and a negative differential output. The first regulated linear voltage source may include a first linear voltage source having an input and an output, and a first amplifier operable to receive a control voltage at a first positive input and a first feedback voltage at a first negative input. An output of the first amplifier may be electrically coupled to the input of the first linear voltage source. The second regulated linear voltage source may include a second linear voltage source having an input and an output, and a second amplifier operable to receive a control voltage at a second positive input and a second feedback voltage at a second negative input. An output of the second amplifier may be electrically coupled to the input of the second linear voltage source. The output of the first linear voltage source may be electrically coupled to the output of the second linear voltage source and operable to supply a current to an electrical load. The positive differential input of the differential amplifier may be electrically coupled to the output of the first linear voltage source. The negative differential input of the differential amplifier may be electrically coupled to the output of the second linear voltage source. The positive differential output of the differential amplifier may be operable to provide the first feedback voltage of the first regulated linear voltage source. The negative differential output of the differential amplifier may be operable to provide the second feedback voltage of the second regulated linear voltage source.

In one aspect, a current-balanced linear voltage source system may include a plurality of regulated linear voltage sources. Each of the plurality of regulated linear voltage sources may include a linear voltage source having an input and an output and an amplifier operable to receive a control voltage at a positive input and a feedback voltage at a negative input. An output of the amplifier may be electrically coupled to the input of the linear voltage source, and the outputs of the linear voltage sources may include the plurality of regulated linear voltage sources that are mutually electrically coupled and operable to supply a current to an electrical load. Additionally, the current-balanced linear voltage source system may include a control circuit, which may be composed of a plurality of control inputs and a plurality of control outputs. Each of the plurality of control inputs may be electrically coupled to one of the plurality of linear voltage source outputs of the plurality of regulated linear voltage source. Each of the plurality of control outputs may provide a feedback voltage to, and may be electrically coupled to, one of the negative inputs of the plurality of regulated linear voltage sources.

Although, the disclosure relates to different aspects and aspects, it is understood that the different aspects and embodiments disclosed herein can be integrated, combined, or used together as a combination system, or in part, as separate components, devices, and systems, as appropriate. Thus, each embodiment disclosed herein can be incorporated in each of the aspects to varying degrees as appropriate for a given implementation. Further, the various apparatus, resistors, amplifiers, digital to analog or analog to digital converter circuits, sample and hold circuits, inputs, outputs, ports, channels, components, and parts of the foregoing disclosed herein can be used with any laser, laser-based communication system, ASIC, photonic integrated circuit, tuner, waveguide, fiber, transmitter, transceiver, receiver, and other devices and systems without limitation.

These and other features of the applicant's teachings are set forth herein.

BRIEF DESCRIPTION OF THE FIGURES

Unless specified otherwise, the accompanying drawings illustrate aspects of the innovations described herein. Referring to the drawings, wherein like numerals refer to like parts throughout the several views and this specification, several embodiments of presently disclosed principles are illustrated by way of example, and not by way of limitation. The drawings are not intended to be to scale. A more complete understanding of the disclosure may be realized by reference to the accompanying drawings in which.

DETAILED DESCRIPTION

Figure 1A:
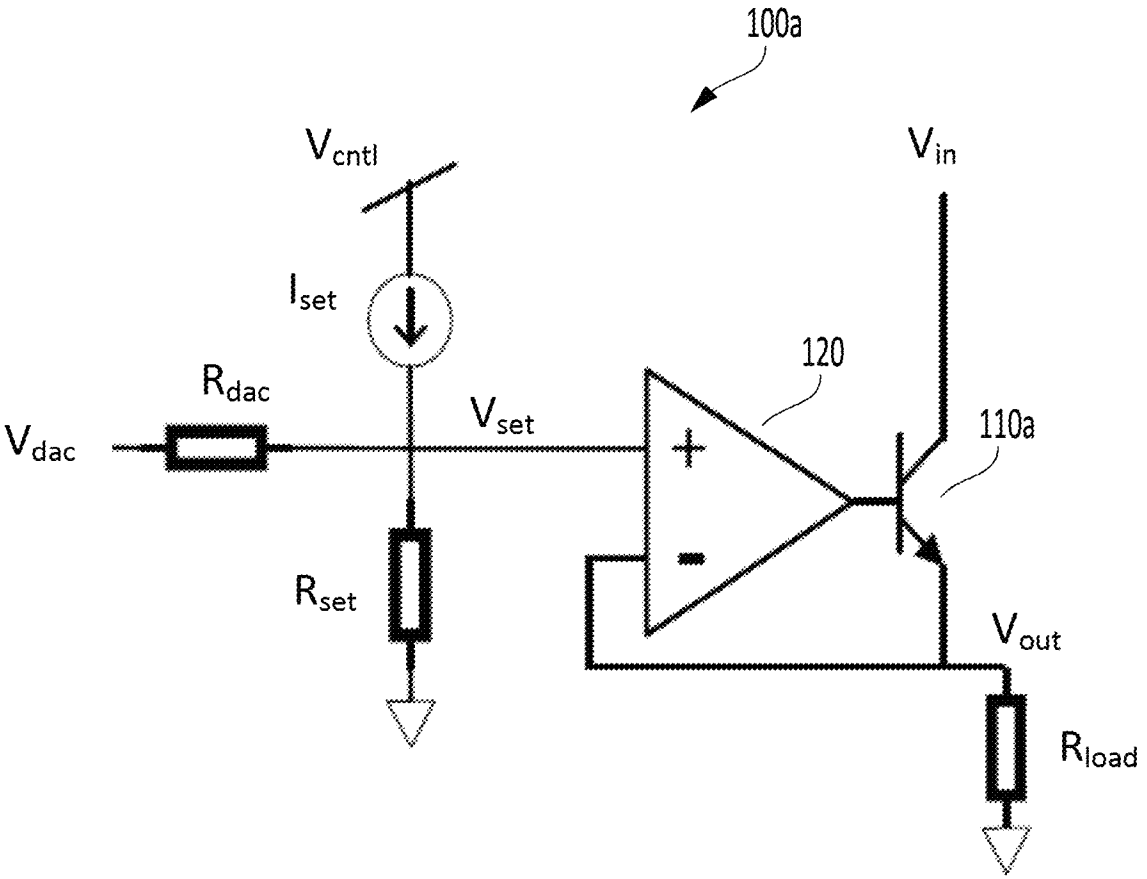
FIG. 1A depicts a schematic of a first linear voltage regulator, according to one aspect of the disclosure.

The following merely illustrates the principles of the disclosure. It will thus be appreciated that those skilled in the art will be able to devise various arrangements which, although not explicitly described or shown herein, embody the principles of the disclosure and are included within its spirit and scope. More particularly, while numerous specific details are set forth, it is understood that embodiments of the disclosure may be practiced without these specific details and in other instances, well-known circuits, structures and techniques have not be shown in order not to obscure the understanding of this disclosure.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the invention.

In addition, it will be appreciated by those skilled in art that any flow charts, flow diagrams, state transition diagrams, pseudocode, and the like represent various processes, which may be substantially represented in computer readable medium and so executed by a computer or processor, whether or not such computer or processor is explicitly shown.

In the claims hereof any element expressed as a means for performing a specified function is intended to encompass any way of performing that function including, for example, a) a combination of circuit elements which performs that function or b) software in any form, including, therefore, firmware, microcode or the like, combined with appropriate circuitry for executing that software to perform the function. The invention as defined by such claims resides in the fact that the functionalities provided by the various recited means are combined and brought together in the manner which the claims call for. Applicant thus regards any means which can provide those functionalities as equivalent as those shown herein. Finally, and unless otherwise explicitly specified herein, the drawings are not drawn to scale.

Thus, for example, it will be appreciated by those skilled in the art that the diagrams herein represent conceptual views of illustrative structures embodying the principles of the disclosure.

By way of some additional background, it is appreciated that electronic circuits (loads) require stable voltage and current supplies for their operations. Typically, two types of voltage supplies are known: linear voltage supplies and switch mode voltage supplies. Both the linear voltage supply and switch mode voltage supply rely on an output series transistor to source the output current to the load. For the linear voltage supply, the current supplied by the output series transistor is regulated by an amplifier with appropriate feedback control. The switch mode voltage supply uses a digital clock to activate the transistor and control the output current. Typically, the switch mode voltage supply is able to supply a greater amount of current to the load because the output transistor sources current only briefly, due to the clocking circuit, and therefore does not overhead. The linear voltage supply has the output transistor running constantly, and therefore the output current must be controlled to prevent transistor overheating. However, while the typical switch mode voltage supply is able to supply more current than the typical linear voltage supply, the output of the switch mode voltage supply requires significant filtering to remove frequencies associated with the control clock and its harmonics. Some circuit applications that require significant current may be highly sensitive to voltage supply noise. Therefore, there is a need for a high current, very low noise, linear voltage supply.

In one solution, multiple linear voltage supplies may be coupled in parallel so that their individual output currents may add while the supplies all have the same output voltages. However, when two or more regulators operate in parallel without extra feedback control loop, a mismatch between the two regulator circuits (components tolerances, temperature coefficient, internal offsets and so forth) may create an imbalance between the two regulators output voltages, which may lead to an imbalance between the output currents of the two. This imbalance may result in a serious imbalance and some cases may result in an over-load condition and/or result in excessive thermal dissipation as one regulator could source the majoring of the current to the load.

Figure 1B:
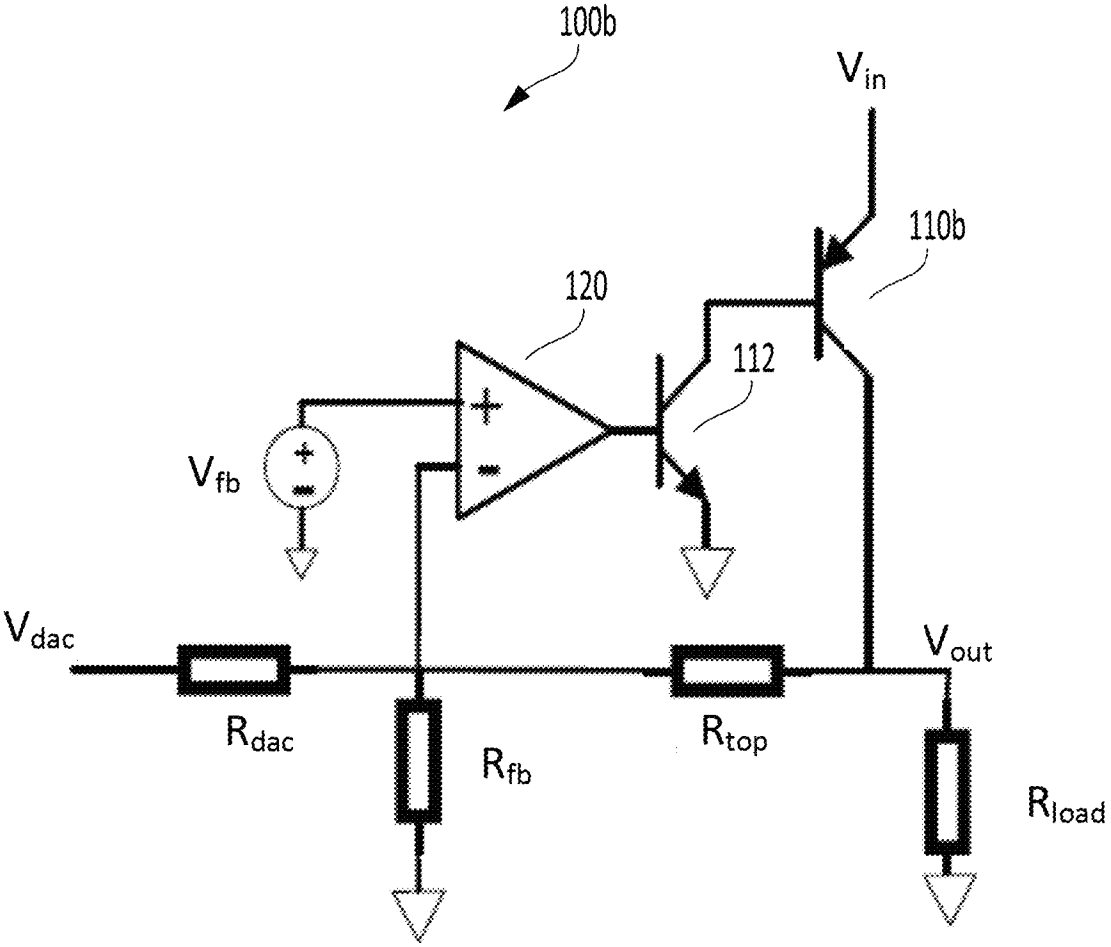
FIG. 1B depicts a schematic of a second linear voltage regulator, according to one aspect of the disclosure.

FIGS. 1A and 1B depict schematics of two aspects of linear voltage sources. FIG. 1A depicts a first aspect of a linear voltage source 100*a*, comprising an output transistor 110*a* (an NPN transistor) and a feedback amplifier 120. The feedback amplifier 120 may have a positive input and a negative input. The output of the feedback amplifier 120 may be connected to the base of the output transistor 110*a*. The output transistor 110*a* may source a current to the load (represented by $R_{load}$) at a voltage $V_{out}$. The output voltage $V_{out}$ is also fed back to the feedback amplifier 120 at the negative feedback input. The value of the output voltage $V_{out}$ may be set by a fixed voltage source, control voltage $V_{cntl}$. A set-point current $I_{set}$ is generated at the set-point resistor $R_{set}$ based on the control voltage $V_{cntl}$. A set-point voltage $V_{set}$ is supplied to the feedback amplifier 120 at the positive input. As a result of the feedback voltage at the feedback amplifier 120 negative input, the output voltage $V_{out}$ may be stabilized based on setpoint voltage $V_{set}$. If it is desired to have a variable controlled output of the linear voltage source 100*a*, an adjustable output control voltage $V_{dac}$ may be used to alter $V_{set}$ at the positive input of the feedback amplifier 120 via the series resistor $R_{dac}$. Thus, a value of a set-point voltage $V_{set}$ at the positive input of the feedback amplifier 120 may be a function of the combined values of $V_{dac}$, $R_{dac}$, $V_{cntl}$, and $R_{set}$. The output voltage $V_{out}$ of the linear voltage source 100*a* is thus stabilized to a value determined by $V_{set}$. It may be understood that the control voltage $V_{dac}$ may be generated by any appropriate DC voltage generator circuit. In one non-limiting example, the generator circuit may be an analog circuit, such as a DC voltage source coupled to a variable resistor voltage divider. In another non-limiting example, the generator circuit may be a digital circuit may include a programmable digital to analog circuit.

FIG. 1B depicts a second aspect of a linear voltage source 100*b*, comprising an output transistor 110*b* (a PNP transistor), a drive transistor 112 (NPN transistor), and a feedback amplifier 120 having a positive input and a negative input. The output transistor 110*b* sources current to the load (represented by $R_{load}$) at a voltage $V_{out}$. The feedback amplifier 120 does not directly control the output transistor 110*b*, as in linear voltage source 100*a* (see FIG. 1A). Instead, the feedback amplifier 120 output drives the drive transistor 112, which in turn, drives the output transistor 110*b*. The output voltage $V_{out}$ is also fed back to the feedback amplifier 120 at the negative feedback input via resistor $R_{top}$. The value of the output voltage $V_{out}$ may be set by a control voltage $V_{fb}$, which is supplied to the feedback amplifier 120 at the positive input. As a result of the feedback voltage at the feedback amplifier 120, the output voltage $V_{out}$ may be stabilized based on control voltage $V_{fb}$. If it is desired to have a variable controlled output of the linear voltage source 100*b*, an adjustable output voltage control $V_{dac}$ may be combined at the negative feedback input of feedback amplifier 120 with the feedback from $V_{out}$ via the series resistor $R_{dac}$. Resistor $R_{fb}$ may operate in a similar manner as $R_{set}$ in linear voltage source 100*a*. Thus, the output voltage $V_{out}$ of the linear voltage source 100*b* is stabilized based on a function of the combined values of $V_{dac}$, $R_{dac}$, $V_{fb}$, $R_{fb}$ and $R_{top}$. It may be understood that the control voltage $V_{dac}$ may be generated by any appropriate DC voltage generator circuit. In one non-limiting example, the generator circuit may be an analog circuit, such as a DC voltage source coupled to a variable resistor voltage divider. In another non-limiting example, the generator circuit may be a digital circuit may include a programmable digital to analog circuit.

Figure 2:
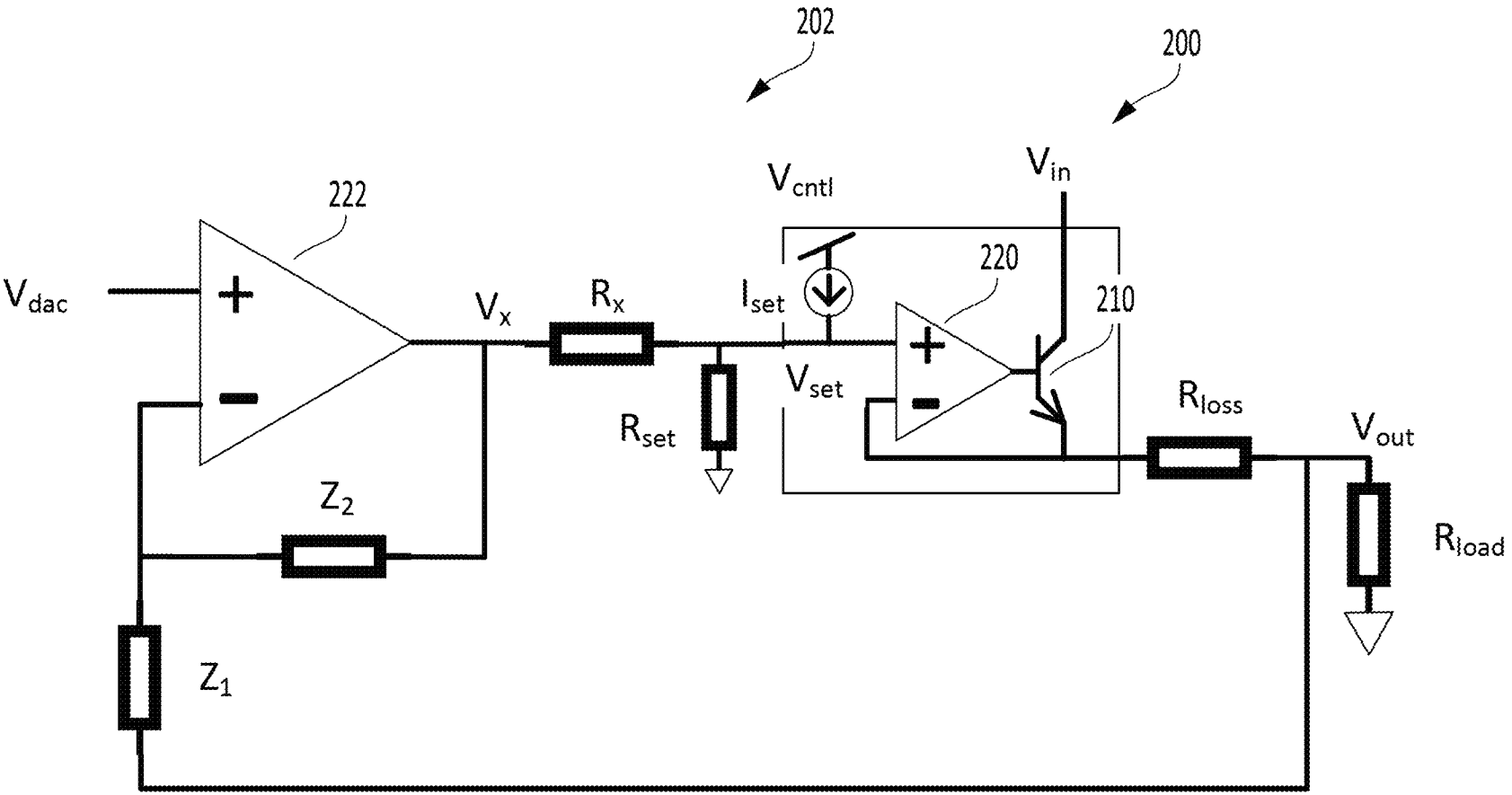
FIG. 2 depicts a schematic of a regulated linear voltage source, including the first linear voltage regulator of FIG. 1A, according to one aspect of the disclosure.

It may be recognized that the linear voltage sources 100*a,b* may be inherently stable without the variable control voltage (supplied by $V_{dac}$). However, the potential time dependent changes of $V_{dac}$ may lead to $V_{out}$ instability unless additional feedback is included. FIG. 2 illustrates a regulated linear voltage source 202 having additional stabilizing feedback. The regulated linear voltage source 202 is built from the linear voltage source 200 (similar to linear voltage source 100*a* in FIG. 1A), including the output transistor 210 (an NPN transistor) and a feedback amplifier 220 having a positive input and a negative input. The internal feedback loop from the output of the output transistor 210 to the negative input of the feedback amplifier 220 is the same as in linear voltage source 200. The feedback amplifier 220 similarly receives setpoint voltage $V_{set}$ at its positive input, based in part on current $I_{set}$ generated by voltage $V_{cntl}$ and resistor $R_{set}$.

As depicted in FIG. 1A, variable control voltage $V_{dac}$ feeds through resistor $R_{dac}$ directly into the positive input of the feedback amplifier 120. In regulated linear voltage source 202, the variable control voltage $V_{dac}$ is provided to the positive input of amplifier 222. The output of amplifier 222 ($V_x$) is then sourced to the positive input of the feedback amplifier 220 via resistor $R_x$ (operating similarly to $R_{dac}$ in FIG. 1A). The feedback loop is closed through the sourcing of $V_{out}$ to the negative input of amplifier 222. For the regulated linear voltage source 202 depicted in FIG. 2, $V_{out}$ is not generated as the output of the output transistor 210. Rather, $V_{out}$ is measured between a sensing resistor, $R_{loss}$, and the equivalent load resistance, $R_{load}$. The feedback function at amplifier 222 is based on the summation of voltages $V_x$ and $V_{out}$ at the negative input of amplifier 222. The ratio between the feedback impedance elements $Z_2$ and $Z_1$ define the feedback gain at amplifier 222. In some aspects, the feedback impedance elements $Z_2$ and $Z_1$ may both comprise resistors. However, $Z_2$ and $Z_1$ may be any appropriate impedance elements including, without limitation, resistors or capacitors, alone or in combination. In general, this disclosure may consider $Z_2$ and $Z_1$ to comprise resistors, although this is not required.

It may be understood that a regulated linear voltage source, such as regulated linear voltage source 202 depicted in FIG. 2, may incorporate a linear voltage source similar to linear voltage source 100*b* (FIG. 1B) as an alternative to linear voltage source 100*a* (FIG. 1A). It may further be understood that a regulated linear voltage source may not be restricted to one including either linear voltage sources 100*a* or 100*b*. Alternative linear voltage sources are contemplated as forming the current output stage of the regulated linear voltage source.

Figure 3:
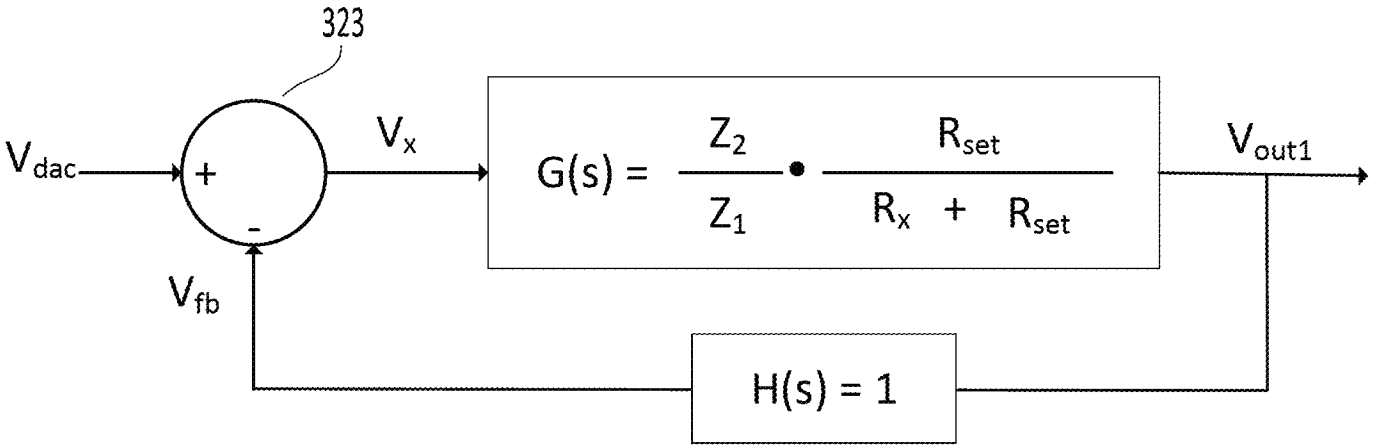
FIG. 3 depicts a small signal analysis of the regulated linear voltage source depicted in FIG. 2, according to one aspect of the disclosure.

FIG. 3 illustrates a small-signal analysis of the regulated linear voltage source circuit 202 schematically presented in FIG. 2. References $V_x$, $V_{dac}$, $Z_2$, $Z_1$, $R_{set}$, and $R_x$ represent the same elements of FIG. 2. $V_{fb}$ is the feedback voltage from output $V_{out1}$. Summer 323 accepts inputs from both the control voltage $V_{dac}$ (at the positive input) and the feedback voltage $V_{fb}$ (at the negative input) and produces an output voltage $V_x$. As illustrated in FIG. 3, the open-loop gain G(s) is the product of the amplifier gain $Z_2/Z_1$ and the voltage divider proportionality value $R_{set}/(R_x+R_{set})$ as depicted in FIG. 2. The feedback factor, H(s), here may be taken as unity. As may be readily determined, $$V_{out1} = V_{dac}\frac{G(s)}{1+G(s)H(s)} \qquad \text{Eq. (1)}$$

In some configurations, current $I_{set}$ from $V_{cntl}$ may flow directly into feedback amplifier 220, thereby eliminating resistors $R_{set}$ and $R_x$ from the linear voltage source 200. In view of Eq. (1), above, G(s) may be taken as the product of the amplifier gain $Z_2/Z_1$ and the voltage divider proportionality value $R_{set}/(R_x+R_{set})$ when $R_x=0$ and $R_{set}$ approaches infinity. Under these conditions, $R_{set}/(R_x+R_{set})$ approaches 1 as $R_{set}$ approaches infinity, so G(s) approaches the amplifier gain $Z_2/Z_1$.

As disclosed above, a configuration to increase the current output of a regulated linear voltage source may include connecting multiple regulated linear voltage sources in parallel. It has been noted that simply connecting the outputs of the multiple regulated linear voltage sources together may result in unequal loading on the voltage sources. It is therefore useful to include a feedback component that assures that the output of each regulated linear voltage source contributes equally to the total current supplied to the output load.

Figure 4:
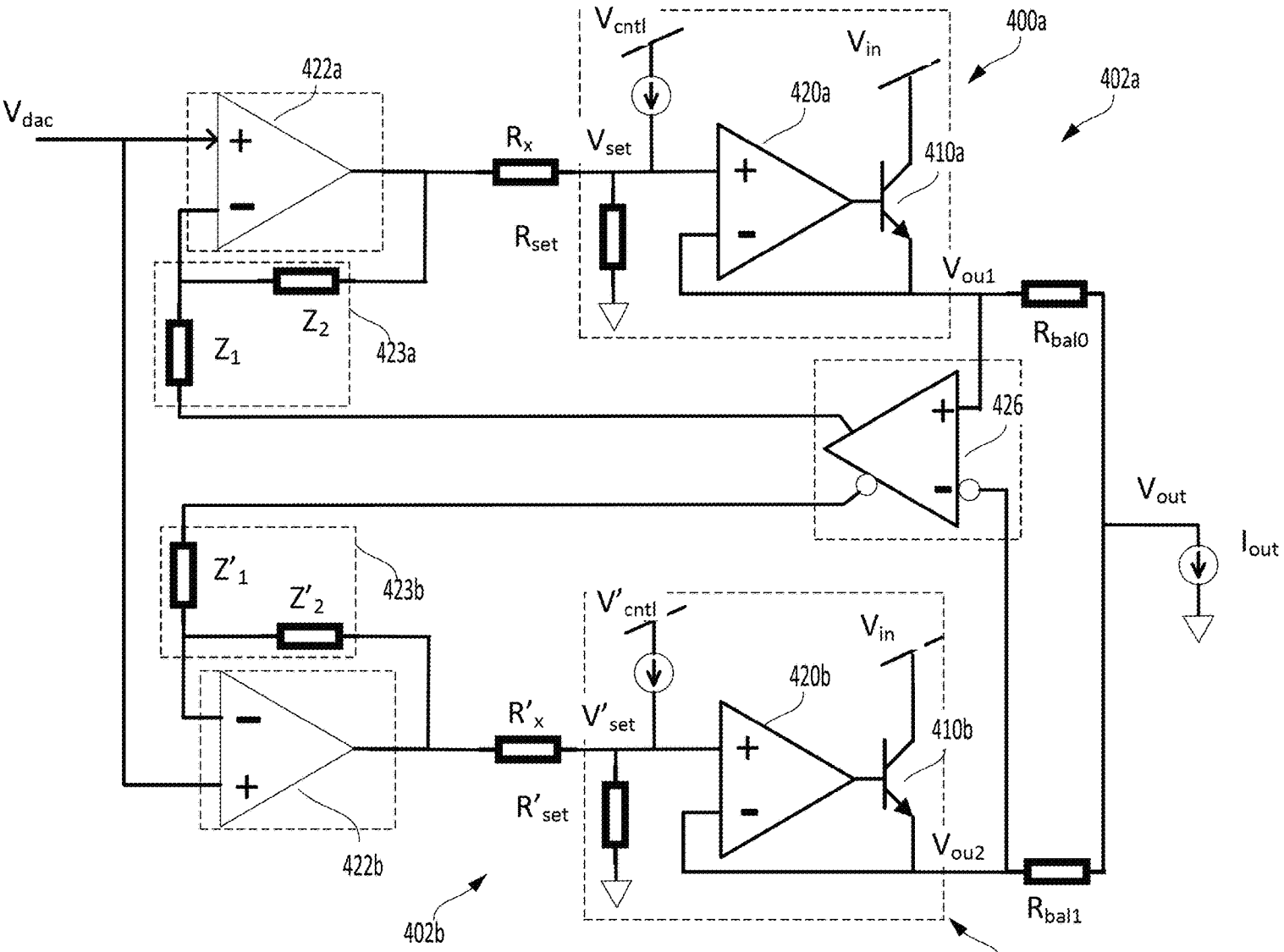
FIG. 4 depicts a schematic of a current balancing regulated linear voltage source, according to one aspect of the disclosure.

FIG. 4 depicts a regulated current-balanced linear voltage source compose of two regulated linear voltage sources 402*a* and 402*b* in parallel. Together, the outputs of each regulated linear voltage source are combined to source a current $I_{out}$ to a load (represented by resistor $R_L$) at a voltage $V_{out}$. Each of the regulated linear voltage sources 402*a,b* is similar in design as the regulated linear voltage source 202 depicted in FIG. 2. Thus regulated linear voltage source 402*a* is composed of linear voltage source 400*a*, which may include an output transistor 410*a* and a feedback amplifier 420*a* having a positive input and a negative input. Output transistor 410*a* and feedback amplifier 420*a* have the same topology as output transistor 210*a* and feedback amplifier 220 in FIG. 2. For example, the output of feedback amplifier 420*a* is connected to the base of output transistor 410*a*. Thus, the voltage output $V_{ou1}$ of the output transistor 410*a*, is fed back to the feedback amplifier 420*a* at the negative input. Linear voltage source 400*a* further incorporates a set-point control voltage $V_{cntl}$ and set-point resistor $R_{set}$. A set-point voltage $V_{set}$ is supplied to the feedback amplifier 420*a* at the positive input. It may be understood that regulated linear voltage source 402*b* is similarly defined as being composed of linear voltage source 400*b*, which may include an output transistor 410*b* and a feedback amplifier 420*b* having a positive input and a negative input. Output transistor 410*b* and feedback amplifier 420*b* also have the same topology as output transistor 210*a* and feedback amplifier 220 in FIG. 2. For example, the output of feedback amplifier 420*b* is connected to the base of output transistor 410*b*. Thus, the voltage output $V_{ou2}$ of the output transistor 410*b*, is fed back to the feedback amplifier 420*b* at the negative input. Linear voltage source 400*b* further incorporates a set-point control voltage $V'_{cntl}$ and set-point resistor $R'_{set}$.

Both regulated linear voltage sources 402*a,b* also have amplifiers, 422*a,b*, respectively, that operate similarly to amplifier 222 in FIG. 2. Both amplifiers 422*a* and 422*b* receive a positive input from a control voltage $V_{dac}$ at their respective positive inputs, and each receive a feedback signal at their respective negative inputs. The negative feedback input to amplifier 422*a* has feedback impedances 423*a* comprising impedance elements $Z_1$ and $Z_2$, while amplifier 422*b* has feedback impedances 423*b* comprising impedance elements $Z'_1$ and $Z'_2$, also as depicted in FIG. 2. In some aspects, feedback impedance elements $Z_1$, $Z_2$, $Z'_1$, and $Z'_2$ may all be resistors.

Alternatively, feedback impedance elements $Z_1$, $Z_2$, $Z'_1$, and $Z'_2$ may comprise one or more impedance elements including, for example, one or more resistors, capacitors, or combination thereof. In generally, these impedance elements will be taken as resistors unless otherwise explicitly disclosed. It may be recognized that feedback impedance element $Z_2$ of regulated linear voltage source 402*a* may have the same impedance value as feedback impedance element $Z'_2$ of regulated linear voltage source 402*b*. Further, feedback impedance element $Z_1$ of regulated linear voltage source 402*a* may have the same impedance value as feedback impedance element $Z'_1$ of regulated linear voltage source 402*b*. However, it may be recognized that equivalent impedance elements $Z_1$ and $Z'_1$, and $Z_2$ and $Z'_2$ may differ in their respective impedance values.

The total current sourced to the load, $I_{out}$, is the sum of the current supplied by regulated linear voltage source 402*a* and regulated linear voltage source 402*b*. The output current from each regulated linear voltage source may be determined by relative values of the balancing resistors, $R_{bal0}$ and $R_{bal1}$.

As depicted in FIG. 2, the feedback from the output transistor 210 to the amplifier 222 is taken downstream of sensing resistor, $R_{loss}$. This feedback provides sufficient control for the single regulated linear voltage source 202. However, the current-balanced linear voltage source configuration depicted in FIG. 4 requires feedback to each of the regulated linear voltage sources 402*a,b* that mutually balance the output current of each regulated linear voltage source. The feedback from the output of the output transistors, 410*a,b* to the respective amplifiers 422*a,b*, may be mediated by a differential amplifier 426. In this manner, the respective feedback voltages to amplifiers 422*a* and 422*b* are dependent on the difference between the output voltages of linear voltage source 400*a* and linear voltage source 400*b*. Thus, the positive input of the differential amplifier 426 is electrically coupled to the output of the first linear voltage source 402*a* and the negative differential input of the differential amplifier 426 is electrically coupled to the output of the second linear voltage source 402*b*. The positive differential output of the differential amplifier 426 may be operable to provide the first feedback voltage to the first regulated linear voltage source 402*a* at amplifier 422*a* and the negative differential output of the differential amplifier 426 may be operable to provide the second feedback voltage of the second regulated linear voltage source 402*b* at amplifier 422*b*.

Figure 5:
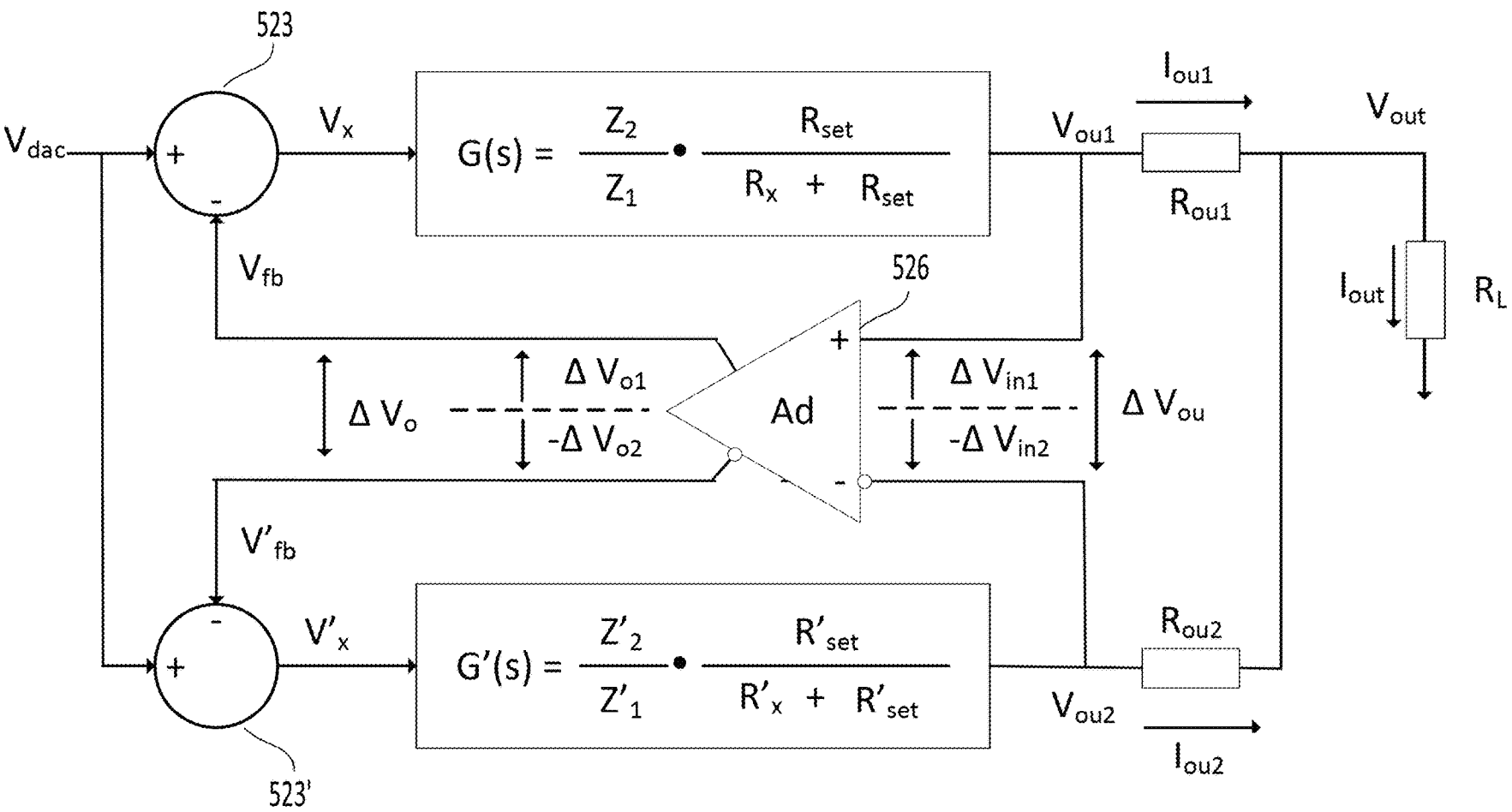
FIG. 5 depicts a small signal analysis of the current balancing regulated linear voltage source depicted in FIG. 4, according to one aspect of the disclosure.

FIG. 5 illustrates a small signal analysis of the current-balanced linear voltage source depicted in FIG. 4. For the purpose of this analysis, it may be understood that the current-balanced linear voltage source comprises a symmetric pair of regulated linear voltage sources. Accordingly, when the positive branch at $\Delta V_{ou}$ increases, the negative feedback of this branch, corresponding to regulated linear voltage source 402*a* in FIG. 4, counters it. Similarly, when the negative branch at $\Delta V_{ou}$ increases, the negative feedback of this branch, corresponding to regulated linear voltage source 402*b* in FIG. 4, counters it as well. Thus, for each branch of the differential amplifier 526:

$$\Delta V_{o1}=Ad*\Delta V_{in1} \quad \text{Eq. (2)}$$

$$-\Delta V_{o2}=Ad*(-\Delta V_{in2}) \quad \text{Eq. (3)}$$

$$\Delta V_{ou}=V_{ou1}-V_{ou2}=\Delta V_{in1}-(-\Delta V_{in2}) \quad \text{Eq. (4)}$$

$$\Delta V_0=\Delta V_{o1}-(-\Delta V_{o2})=Ad*\Delta V_{ou} \quad \text{Eq. (5)}$$

where Ad is the gain of differential amplifier 526. Additionally, $\Delta V_{in1}$ is the positive input to differential amplifier 526 (compared to ground), $-\Delta V_{in2}$ is the negative input to differential amplifier 526 (compared to ground), $\Delta V_{o1}$ is the positive output from differential amplifier 526 (compared to ground), and $-\Delta V_{o2}$ is the negative output from differential amplifier 526 (compared to ground).

For the "positive" regulated branch, corresponding to regulated linear voltage source 402*a* in FIG. 4, from Eq. (1), above, $$\Delta V_{in1} = V_{dac}\frac{G(s)}{1+G(s)*Ad} = V_{ou1} \quad \text{Eq. (6)}$$

and from Eq. 2, $$\Delta V_{o1}=Ad*\Delta V_{in1}$$

The summer 523 of the positive branch combines the feedback voltage, $\Delta V_{o1}=V_{fb}$ with the control voltage $V_{dac}$ similar to summer 323 as depicted in FIG. 3. The output voltage of the summer 523 is $V_x$, also as discussed with respect to summer 323 of FIG. 3. Similarly, as discussed above with respect to FIG. 3, the open loop gain, G(s), is defined as $$G(s) = \frac{Z_2}{Z_1} * \frac{R_{set}}{R_x + R_{set}}$$

Similarly, for the "negative" regulated branch, corresponding to regulated linear voltage source 402*b* in FIG. 4, $$-\Delta V_{in2} = V_{dac}\frac{G'(s)}{1+G'(s)*Ad} = -V_{ou2} \quad \text{Eq. (7)}$$

In which the open loop gain G'(s) may similarly be defined as $$G'(s) = \frac{Z'_2}{Z'_1} * \frac{R'_{set}}{R'_x + R'_{set}}$$

It may be understood that G'(s) may equal G(s), and that the equivalent component, $Z_2$ and $Z'_2$, $Z_1$ and $Z'_1$, $R_{set}$ and $R'_{set}$, and $R_x$, and $R'_x$, may have the same values. Alternatively, G'(s) may not equal G(s), and the equivalent component, $Z_2$ and $Z'_2$, $Z_1$ and $Z'_1$, $R_{set}$ and $R'_{set}$, and $R_x$, and $R'_x$, may not have the same values.

From Eq. (3), it may be understood $$-\Delta V_{o2}=Ad*(-\Delta V_{in2})$$

In which the inverted input results in an inverted output of the differential amplifier 526. For current balancing between the two branches, $I_{ou1}$ should equal $I_{ou2}$. Thus, for $$I_{ou1}=\frac{V_{ou1}-V_{out}}{R_{ou1}}$$

and $$I_{ou2}=\frac{V_{ou2}-V_{out}}{R_{ou2}},$$

then $I_{ou1}-I_{ou2}=V_{ou1}-V_{ou2}=0$, for $R_{ou1}=R_{ou2}$.

Therefore, from Eq. (6) and Eq. (7)

$$V_{ou1}-V_{ou2}=V_{dac}\frac{G(s)}{1+G(s)*Ad}+V_{dac}\frac{G'(s)}{1+G'^{(s)}*Ad}=2*V_{dac}\frac{G(s)}{1+G(s)*Ad} \quad \text{Eq. (8)}$$

if G(s)=G'(s). If the equivalent component of G(s) and G'(s)—$Z_2$ and $Z'_2$, $Z_1$ and $Z'_1$, $R_{set}$ and $R'_{set}$, and $R_x$, and $R'_x$,—have the same values, then $$V_{ou1}-V_{ou2}=2*V_{dac}\frac{\frac{z_2}{z_1}*\frac{R_{set}}{R_x+R_{set}}}{1+\frac{z_2}{z_1}*\frac{R_{set}}{R_x+R_{set}}*Ad} \quad \text{Equ. (9)}$$

As noted above for the current balancing, it is desirable to have $I_{ou1}=I_{ou2}$. Thus, $$I_{ou1}=\frac{V_{ou1}-V_{out}}{R_{ou1}} \text{ and } I_{ou2}=\frac{V_{ou2}-V_{out}}{R_{ou2}}$$

For $\Delta I=I_{ou1}-I_{ou2}$, $$\Delta I=\frac{V_{ou1}-V_{out}}{R_{ou1}}-\frac{V_{ou2}-V_{out}}{R_{ou2}}$$

The variability in ΔI due to the resistors, is thus $$d(\Delta I)=-\frac{V_{ou1}-V_{out}}{R_{ou1}^2}*d(R_{ou1})+\frac{V_{ou2}-V_{out}}{R_{ou2}^2}*d(R_{ou2})$$

which reduces to $$d(\Delta I)=-I_{ou1}*\frac{d(R_{ou1})}{R_{ou1}}+I_{ou2}\frac{d(R_{ou2})}{R_{ou2}}$$

We may consider that the tolerances of resistors $R_{ou1}$ and $R_{ou2}$ are primarily due to manufacturing variables, which are independent of the individual resistor. Therefore, we can take $$\frac{d(R_{ou1})}{R_{ou1}}=\frac{d(R_{ou2})}{R_{ou2}}$$

and therefore $$d(\Delta I)=\frac{d(R_{ou1})}{R_{ou1}}*(\Delta I)$$

which leads to $$\frac{d(\Delta I)}{\Delta I}=\frac{d(R_{ou1})}{R_{ou1}}$$

This implies that the variability in the balance of the output currents of the two branches of the current-balanced linear voltage source is equivalent to the tolerance or variability in the output resistors. As a non-limiting example, if the output resistors have a tolerance of about 1%, then the variability in the balancing of the output current between the two branches will also be about 1%.

It may be recognized that the stability of the control loop depends on the location of the poles and zeroes of the regulators and the feedback $Z_2/Z_1$. In general, it is desired to set Ad (the differential amplifier gain) close to 1. For the case of a dominant pole in the regulator's dynamic then:

$$A(s)=\frac{A}{1+\frac{s}{\omega p}}$$

where A(s) is the regulator gain and ωp is the dominant pole. In general, for a feedback loop $$\frac{V_o}{V_i}=\frac{A(s)}{1+A(s)}=\frac{1}{1+\left(\frac{1}{A}+\frac{s}{A*\omega p}\right)}\approx\frac{1}{1+\frac{s}{A*\omega p}}$$

In this case, the feedback loop dominant pole will be A·ωp.

Figure 6:
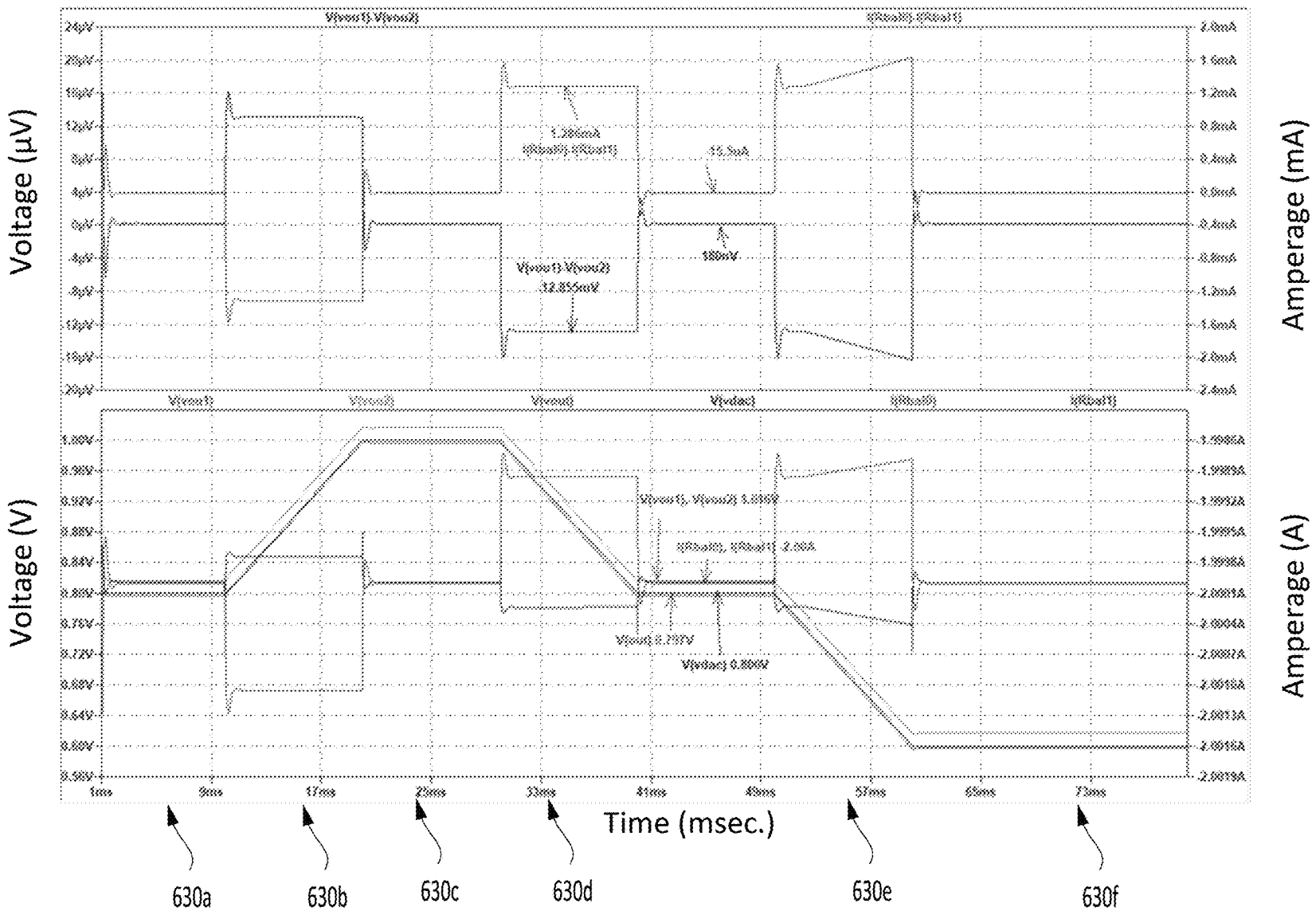
FIG. 6 depicts graphs illustrating simulations of the operations of the current balancing regulated linear voltage source depicted in FIG. 4, according to one aspect of the disclosure.

FIG. 6 depicts graphs of simulations of the circuit depicted in FIG. 4. To create the imbalance between the two regulators, $R_{set}$ was not equal to $R'_{set}$. Therefore, without a feedback loop $V_{ou1}$ would differ from $V_{ou2}$. The feedback loop corrects the voltages at the output of each regulator and balances the current to the load between the two. To minimize the error, $Z_2$ and $Z_1$ and $Z'_2$ and $Z'_1$, which are part of the loop filters, were configured as integrators. In the example above the load current is a current source of 4A. $R_{bal0}$ and $R_{bal1}$ were set at 10 mohm each. They represent the balance resistors and the path losses.

The circuit may include two regulators connected in parallel as depicted in FIG. 4. In the bottom graph, the control voltage $V_{dac}$ is varied in order to determine the changes in the other output voltage and current values under change. Thus, $V_{dac}$ initiates (630*a*) at 0.8V, and increases (630*b*) to a stable (630*c*) 1.0V. $V_{dac}$ then decreases (630*d*)

back to a stable 0.8V. $V_{dac}$ then decreases (630*e*) down to a stable (630*f*) 0.6V. $V_{dac}$ controls the regulators to nominal 0.8V +/−25%. The simulations show that $V_{out}$ follows the control voltage, $V_{dac}$, with a small offset of about 3 mV. $V(v_{ou1})$ and $V(v_{ou2})$ are the voltages at the output of each regulator, corresponding to $V_{ou1}$ and $V_{ou2}$ in FIG. 4. They are almost identical, and in this plot, they laid one on top of the other due to the resolution (scaling) of the plot. Their voltages are about 1.016V when $V_{dac}$ is set to 0.8V. The difference between $V(v_{ou1})/V(v_{ou2})$ and $V_{out}$ is due to the voltage drop across the respective balance resistors $R_{bal0}$ and $R_{bal1}$. In these simulations, $R_{bal0}$ and $R_{bal1}$ were set to 10 mohm. With 2A from each regulator, the voltage drop on each resistor is about 20 mV, which matches the difference between the outputs of the regulators $V(v_{ou1})$ and $V(v_{ou2})$, and the voltage at the load, $V_{out}$. $I_{out}$ is a current source of 4A. The current through $R_{bal0}$—$I(R_{bal0})$, also $I_{ou1}$ in FIG. 5—maintains a steady state at 2A. Similarly, the current through $R_{bal1}$—$I(R_{bal1})$, also $I_{ou2}$ in FIG. 5—also maintains a steady state at 2A. During the transitions of $V_{dac}$ (see 630*b*, 630*d*, and 630*e*) lout changes by no more than 1 mA.

In the top plot, $I(R_{bal0})$–$I(R_{bal1})$ is the difference between the output currents of the two regulators. It can be seen, under steady state conditions (see 630*a*, 630*c*, and 63*f*), that the difference in the output currents of the two regulators is only a few micro-amps. During the transitions of $V_{dac}$ (see 630*b*, 630*d*, and 630*e*), it may reach +/−1.28 mA, depending on the negative or positive slope of the $V_{dac}$ transition. This implies that the current balancing of the two regulators is maintained tightly during the transitions and returns to a well-balanced state when the control voltage stabilizes. Similarly, the difference in output voltages of the regulators—$V(v_{ou1})$–$V(v_{ou2})$ differ by less than 1 μV when control voltage $V_{dac}$ is in a steady-state condition. During the transition in $V_{dac}$, $V(v_{ou1})$–$V(v_{ou2})$ may be about +/−12.85 mV depending on the slope of the $V_{dac}$ transition.

In summary, the simulations show that current balancing was achieved. Without the feedback loop, when the control voltage (at the resistors $R_x$ and $R'_x$) of the two regulators was set to the same value, one regulator drew almost 4A, while the second regulator drew only few milliamps. This emphasizes the importance of the current balancing.

Figure 7:
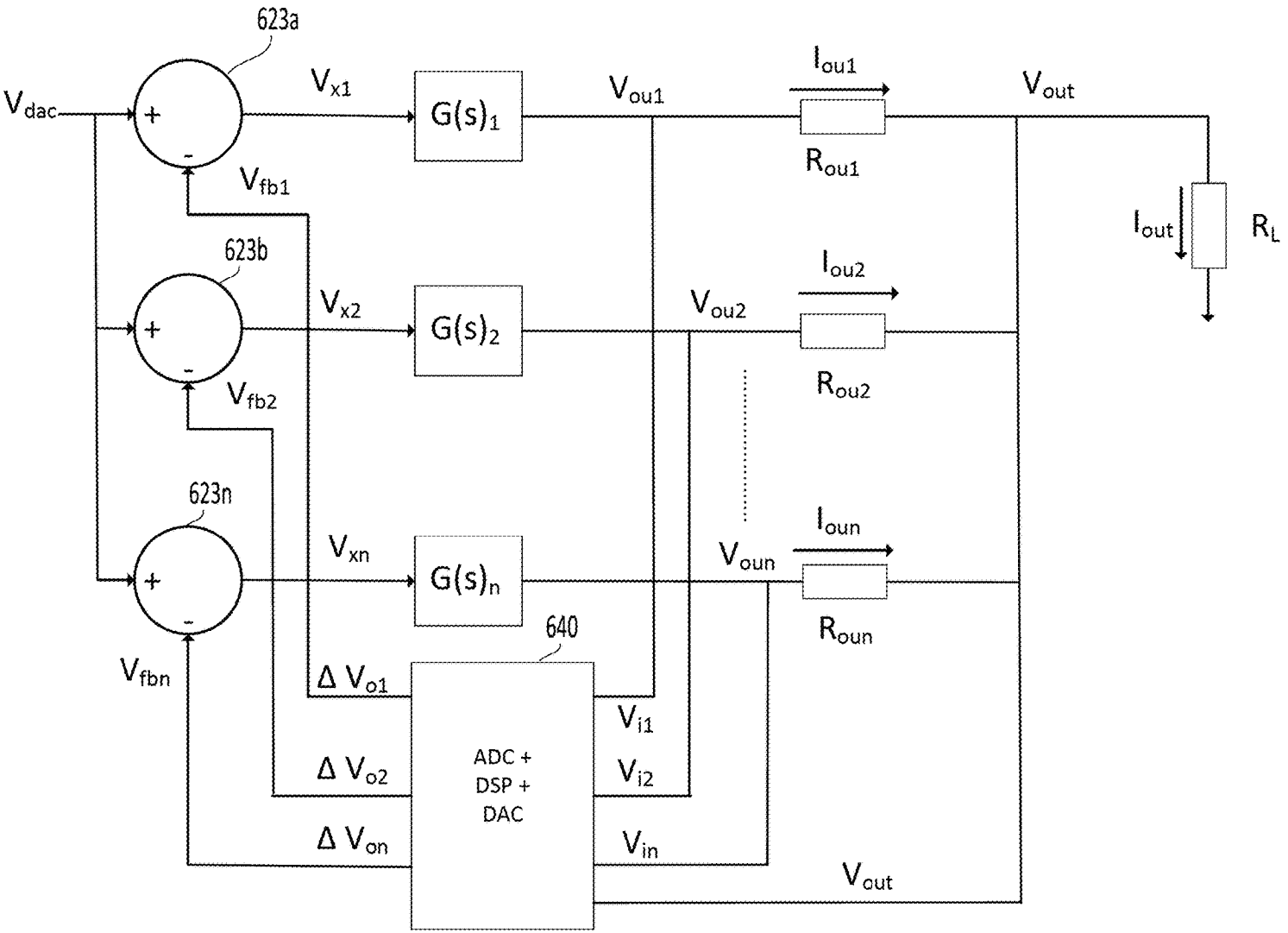
FIG. 7 depicts a small signal analysis of a second current balancing regulated linear voltage source, according to one aspect of the disclosure.

It may be understood that more than two regulated linear voltage sources can be combined in parallel to form a high current, low noise current-balanced linear voltage source. In such cases, the overall feedback feature may be effected by a control circuit receiving the outputs of each of the regulated linear voltage sources, and sourcing the required feedback voltage to each of the regulated linear voltage sources in turn. FIG. 7 illustrates one form of a current-balanced linear voltage source composed of multiple regulated linear voltage sources.

The current-balanced linear voltage source depicted in FIG. 7 is composed of multiple regulated linear voltage sources. Each regulated linear voltage source may have the components and topology as depicted in FIG. 2 (specifically, reference 202). Each of these regulated linear voltage sources may be characterized by an open loop gain $G(s)_x$, and sourcing an output current $I_{oux}$ through an output resistor $R_{oux}$. Thus, for n regulated linear voltage sources, there may be n open loop gains (from $G(s)_1$ through $G(s)_n$), n individual output currents ($I_{ou1}$ through $I_{oun}$), through n individual output resistors ($R_{ou1}$ through $R_{oun}$) resulting in n individual output voltages $V_{ou1}$ through $V_{oun}$. The n individual output currents ($I_{ou1}$ through $I_{oun}$) are summed together to a total output current, $I_{out}$. The total output voltage, $V_{out}$, is dependent on the output load resistance $R_L$.

Thus, in general, a current-balanced linear voltage source may be composed of multiple linear voltage sources, in which each linear voltage source has an input and an output, and an amplifier (623*a* through 623*n*) operable to receive a control voltage $V_{dac}$ at a positive input and a feedback voltage $V_{fba}$ through $V_{fbn}$ at a negative input. The output of each the amplifiers $V_{x1}$ through $V_{xn}$ may be electrically coupled to the input of the linear voltage source, the outputs of each of the linear voltage sources may be mutually electrically coupled and operable to supply a current to an electrical load. There is also a control circuit 640 composed of a plurality of control inputs $V_{i1}$ through $V_{in}$, in which each of the control inputs is electrically coupled to one of the linear voltage source outputs. Thus, for example, control input $V_{i1}$ may be coupled to voltage source output $V_{ou1}$, $V_{i2}$ may be coupled to voltage source output $V_{ou2}$, through $V_{in}$ which may be coupled to voltage source output $V_{oun}$. Control circuit 640 may also include an additional input to receive the voltage $V_{out}$. Additionally, the control circuit 640 may include a plurality of control outputs, $\Delta V_{o1}$ through $\Delta V_{on}$, in which each of the control outputs provides a feedback voltage—$V_{fb1}$ through $V_{fbn}$, respectively—electrically coupled to one of the negative inputs of the regulated linear voltage sources. Thus, as an example, output voltage $\Delta V_{o1}$ may source feedback voltage $V_{fb1}$ to amplifier 623*a*, output voltage $\Delta V_{o2}$ may source feedback voltage $V_{fb2}$ to amplifier 623*b*, through output voltage $\Delta V_{on}$ which may source feedback voltage $V_{fbn}$, to amplifier 623*n*.

It may be recognized that the total output current $I_{out}$ is the sum of the currents sourced by each of the n multiple linear voltage sources, or $$I_{out} = \sum_{x=1}^{n} I_{oux}$$

For proper current balancing, all n of the $I_{oux}$ should be equal. Thus $$I_{ou1} = \frac{V_{ou1} - V_{out}}{R_{ou1}} = I_{ou2} = \frac{V_{ou2} - V_{out}}{R_{ou2}} = \ldots = I_{oun} = \frac{V_{oun} - V_{out}}{R_{oun}};$$

It may be recognized that $V_{out}$ is the voltage that is developed by the current $I_{out}$ sourced through the load resistance $R_L$. If all n of the $I_{oux}$ are equal, then each $I_{oux}$ equals $I_{out}/n$. If all output resistors, $R_{oux}$, have the same value ($R_{ou}$) then $$\frac{I_{out}}{n} = \frac{1}{R_{ou}}\left(\frac{V_{ou1} + V_{ou2} + \ldots + V_{oun}}{n} - V_{out}\right)$$

Therefore, for each linear voltage source i, $$V_{oui} - V_{out} = \frac{V_{ou1} + V_{ou2} + \ldots + V_{oun}}{n} - V_{out}$$

As disclosed above, control circuit 640 may receive n voltage inputs $V_{i1}$ through $V_{in}$ one voltage input from the output of each of the multiple regulated linear voltage sources, as well as an input from the $V_{out}$ voltage. The n+1 voltage inputs may be coupled to an n+1–input analogue-to-digital converter (ADC). The n+1–input ADC may be configured to digitize the analog voltage input from each of the n+1 voltage inputs ($V_{i1}$ through $V_{in}$ plus $V_{out}$) into n+1 digitized input signals. The n+1 digitized input signals may then be used as inputs to a calculation unit to calculate the required feedback voltages. The calculation unit may be any type of calculating unit capable of performing the required calculations.

In one non-limiting example, the calculating unit may include a digital signal processing (DSP) unit comprising a processor unit and a memory unit that may store instructions and data for use by the processor unit. Such instructions may be related to the calculations of the various values disclosed below. Such data may also be derived from various input values related to measured voltages as further disclosed below. The calculating unit may calculate a value of a feedback voltage for each of the n regulated linear voltage sources. A digital-to-analog converter (DAC) may be used to convert the digital values of the feedback voltages into the n analog feedback voltages $V_{fb}$. Additional components of the control circuit 640 may include one or more timing clocks, amplifiers, filters, and sample-and-hold components as may be required for proper functioning.

The control circuit 640 may receive each of the n output voltages, $V_{ou1}$ through $V_{oun}$, of the n regulated linear voltage sources. The control circuit may also receive the total output voltage, $V_{out}$, developed by the passing of the total output current $I_{out}$ through the load resistance $R_L$. The n+1 channel ADC may convert the received analog voltages into digital representations of the voltages. The DSP unit may calculate a digital value of an average voltage, $V_{av}$, from the digital representations of the output voltages of the n regulated linear voltage sources. The difference between $V_{av}$ and $V_{out}$ ($\Delta V$, or system voltage difference) may be calculated as well. For each regulated linear voltage source i, the DSP unit may also calculate a linear voltage difference between $V_{out}$ and the output voltage of the $i^{th}$ regulated linear voltage source ($V_{oui}$). Each linear voltage difference may be called $\Delta V_j$. A digital representation of each feedback voltage, $V_{fbi}$ or regulated linear voltage difference, may then be calculated as $\Delta V_i - \Delta V$. As noted above, a well balanced linear voltage supply composed of n individual regulated linear voltage sources in parallel may be characterized as having the voltage and current output of each of the regulated linear voltage sources being essentially the same. In such a case, the outputs of all of the regulated linear voltage sources are identical and thus equal to the average voltage output. It may be understood that a regulated linear voltage source having its voltage output equal to the average voltage of the ensemble of regulated linear voltage sources should require 0V feedback.

Once the calculations for the $V_{fbi}$ are made by the DSP, the digital DSP values may be transferred to an n-channel digital-to-analog converter (DAC) to convert the digital representation of the feedback voltages into analog voltages. The analog voltages may be sourced by the control circuit 640 at the analog output lines $\Delta V_{o1}$ through $\Delta V_{on}$. As indicated in FIG. 7, the output lines $\Delta V_{o1}$ through $\Delta V_{on}$ may source the respective analog feedback voltages $V_{fb1}$ through $V_{fbn}$ to the individual regulated linear voltage sources via there respective amplifiers 623*a-n*.

As disclosed above, the control circuit 640 may be composed of a control voltage generator circuit comprising several digital and/or mixed digital/analog circuits, solely analog components, or a combination of analog and digital components.

Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. It is, therefore, to be understood that the foregoing embodiments are presented by way of example only and that, within the scope of the appended claims and equivalents thereto, inventive embodiments may be practiced otherwise than as specifically described. In addition, any combination of two or more features, systems, articles, materials, and/or methods described herein, if such features, systems, articles, materials, and/or methods are not mutually inconsistent, is included within the scope of the present disclosure.

In most embodiments, a processor may be a physical or virtual processor. In other embodiments, a virtual processor may be spread across one or more portions of one or more physical processors. In certain embodiments, one or more of the embodiments described herein may be embodied in hardware such as a Digital Signal Processor DSP. In certain embodiments, one or more of the embodiments herein may be executed on a DSP. One or more of the embodiments herein may be programmed into a DSP. In some embodiments, a DSP may have one or more processors and one or more memories. In certain embodiments, a DSP may have one or more computer readable storages. In many embodiments, a DSP may be a custom designed ASIC chip. In other embodiments, one or more of the embodiments stored on a computer readable medium may be loaded into a processor and executed.

Also, as described, some aspects may be embodied as one or more methods. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

The phrase "and/or," as used herein in the specification and in the claims, should be understood to mean "either or both" of the elements so conjoined, i.e., elements that are conjunctively present in some cases and disjunctively present in other cases.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The terms "approximately" and "about" may be used to mean within ±20% of a target value in some embodiments, within ±10% of a target value in some embodiments, within ±5% of a target value in some embodiments, and yet within ±2% of a target value in some embodiments. The terms "approximately" and "about" may include the target value.

In the claims, as well as in the specification above, all transitional phrases such as "comprising," "including," "carrying," "having," "containing," "involving," "holding," "composed of," and the like are to be understood to be open-ended, i.e., to mean including but not limited to. The transitional phrases "consisting of" and "consisting essentially of" shall be closed or semi-closed transitional phrases, respectively.

Where a range or list of values is provided, each intervening value between the upper and lower limits of that range or list of values is individually contemplated and is encompassed within the disclosure as if each value were specifically enumerated herein. In addition, smaller ranges between and including the upper and lower limits of a given range are contemplated and encompassed within the disclosure. The listing of exemplary values or ranges is not a disclaimer of other values or ranges between and including the upper and lower limits of a given range.

The use of headings and sections in the application is not meant to limit the disclosure; each section can apply to any aspect, embodiment, or feature of the disclosure. Only those claims which use the words "means for" are intended to be interpreted under 35 USC 112, sixth paragraph. Absent a recital of "means for" in the claims, such claims should not be construed under 35 USC 112. Limitations from the specification are not intended to be read into any claims, unless such limitations are expressly included in the claims.

Embodiments disclosed herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, embodiments may take the form of a computer program product embodied in one or more computer readable medium(s) having computer readable program code embodied thereon.

What is claimed is:

1. A current-balanced linear voltage source, comprising:

a first regulated linear voltage source, comprising:

a first linear voltage source having an input and an output; and a first amplifier operable to receive a control voltage at a first positive input and a first feedback voltage at a first negative input, wherein an output of the first amplifier is electrically coupled to the input of the first linear voltage source;

a second regulated linear voltage source, comprising:

a second linear voltage source having an input and an output; and a second amplifier operable to receive the control voltage at a second positive input and a second feedback voltage at a second negative input, wherein an output of the second amplifier is electrically coupled to the input of the second linear voltage source, wherein the output of the first linear voltage source is electrically coupled to the output of the second linear voltage source and operable to supply a current to an electrical load; and a differential amplifier having a positive differential input, a negative differential input, a positive differential output, and a negative differential output, wherein:

the positive differential input is electrically coupled to the output of the first linear voltage source; and the negative differential input is electrically coupled to the output of the second linear voltage source;

the positive differential output is operable to provide the first feedback voltage of the first regulated linear voltage source; and the negative differential output is operable to provide the second feedback voltage of the second regulated linear voltage source.

2. The current-balanced linear voltage source of claim 1, wherein the first linear voltage source comprises:

a first feedback amplifier having a positive input, a negative input, and an output; and a first output transistor, wherein the output of the first feedback amplifier is electrically coupled to a base of the first output transistor, wherein the negative input of the first feedback amplifier is electrically coupled to a current output of the first output transistor, wherein the positive input of the first feedback amplifier is electrically coupled to the output of the first amplifier, and wherein the output of the first linear voltage source comprises the current output of the first output transistor.

3. The current-balanced linear voltage source of claim 2, wherein the first linear voltage source further comprises a fixed voltage source electrically coupled to the positive input of the first feedback amplifier.

4. The current-balanced linear voltage source of claim 1, wherein the second linear voltage source comprises:

a second feedback amplifier having a positive input, a negative input, and an output; and a second output transistor, wherein the output of the second feedback amplifier is electrically coupled to a base of the second output transistor, wherein the negative input of the second feedback amplifier is electrically coupled to a current output of the second output transistor, wherein the positive input of the second feedback amplifier is electrically coupled to the output of the second amplifier, and wherein the output of the second linear voltage source comprises the current output of the second output transistor.

5. The current-balanced linear voltage source of claim 4, wherein the second linear voltage source further comprises a fixed voltage source electrically coupled to the positive input of the second feedback amplifier.

6. The current balanced linear voltage source of claim 1, further comprising a control voltage generator circuit operable to generate the control voltage.

7. The current-balanced linear voltage source of claim 6, wherein the control voltage generator circuit comprises an analog circuit.

8. The current-balanced linear voltage source of claim 6, wherein the control voltage generator circuit comprises a digital circuit.

9. The current-balanced linear voltage source of claim 8, wherein the digital circuit comprises a digital to analog converter.

10. A current-balanced linear voltage source system, comprising:

a plurality of regulated linear voltage sources, wherein each of the plurality of regulated linear voltage sources comprises:

a linear voltage source having an input and an output; and an amplifier operable to receive a control voltage at a positive input and a feedback voltage at a negative input, wherein an output of the amplifier is electrically coupled to the input of the linear voltage source, wherein the outputs of the linear voltage sources comprising the plurality of regulated linear voltage sources are mutually electrically coupled and operable to supply a current to an electrical load; and a control circuit, wherein the control circuit comprises:

a plurality of control inputs, wherein each of the plurality of control inputs is electrically coupled to one of the plurality of linear voltage source outputs of the plurality of regulated linear voltage source; and a plurality of control outputs, wherein each of the plurality of control outputs provides a feedback voltage and is electrically coupled to one of the negative inputs of the plurality of regulated linear voltage sources.

11. The current-balanced linear voltage source system of claim 10, wherein the linear voltage source of each of the plurality of regulated linear voltage sources, comprises:

a feedback amplifier having a positive input, a negative input, and an output; and an output transistor, wherein the output of the feedback amplifier is electrically coupled to a base of the output transistor, wherein the negative input of the feedback amplifier is electrically coupled to a current output of the output transistor, wherein the positive input of the feedback amplifier is electrically coupled to the output of the amplifier, and wherein the output of the linear voltage source of each of the plurality of regulated linear voltage sources comprises the current output of the output transistor of the linear voltage source.

12. The current-balanced linear voltage source system of claim 11, wherein each of the linear voltage sources of the plurality of regulated linear voltage sources further comprises a fixed voltage source electrically coupled to the positive input of the feedback amplifier of the linear voltage source.

13. The current-balanced linear voltage source system of claim 10, wherein the control circuit further comprises:

an analog to digital converter comprising the plurality of control inputs;

a digital signal processing unit operable to receive a plurality of digital signals, wherein each of the plurality of digital signals corresponds to a digital representation of a value of a voltage output of one of the plurality of linear voltage source outputs of the plurality of regulated linear voltage sources; and a digital to analog converter comprising the plurality of control outputs, wherein the digital to analog converter is operable to receive a plurality of control signals from the digital signal processing unit.

14. The current-balanced linear voltage source system of claim 13, wherein the digital signal processing unit comprises a processor unit and a memory unit, wherein the memory unit is operable to store instructions that, when executed by the processor unit, cause the processor unit to:

receive the plurality of digital signals;

calculate an average of the plurality of digital signals;

calculate a system voltage difference between the average of the plurality of digital signals and a voltage corresponding to the current to the electrical load;

for each of the plurality of digital signals, calculate a linear voltage difference between the digital signal and the voltage corresponding to the current to the electrical load; and for each of the plurality of digital signals, calculate a regulated linear voltage difference between the linear voltage difference calculated for the digital signal and the system voltage difference.

15. The current-balanced linear voltage source system of claim 14, wherein each regulated linear voltage difference calculated for each of the plurality of digital signals comprises one of the plurality of control signals received by the digital to analog converter.

16. The current-balanced linear voltage source system of claim 10, further comprising a control voltage generator circuit operable to generate the control voltage received by each of the amplifiers of the plurality of regulated linear voltage sources.

17. The current-balanced linear voltage source system of claim 16, wherein the control voltage generator circuit comprises an analog circuit.

18. The current-balanced linear voltage source system of claim 16, wherein the control voltage generator circuit comprises a digital circuit.

19. The current-balanced linear voltage source system of claim 18, wherein the digital circuit comprises a digital to analog converter.

* * * * *